US005180234A

United States Patent [19]

Motta

[11] Patent Number: 5,180,234

[45] Date of Patent: Jan. 19, 1993

[54] DOT MATRIX PRINTING HEAD FOR HIGH-DEFINITION OR HIGH-SPEED PRINTING

[75] Inventor: Carlo Motta, Borgofranco D'Ivrea, Italy

[73] Assignee: Microlys S.p.A., Ivrea, Italy

[21] Appl. No.: 785,456

[22] Filed: Oct. 31, 1991

[30] Foreign Application Priority Data

Oct. 31, 1990 [IT] Italy ..... 67859 A/90

[51] Int. Cl.[5] ..... B41J 2/25

[52] U.S. Cl. ..... 400/124; 400/121

[58] Field of Search ..... 400/124 GT, 124 VI, 400/124, 121

[56] References Cited

U.S. PATENT DOCUMENTS

| | | | |
|---|---|---|---|
| 3,842,955 | 10/1974 | Iwasaki | 400/124 |
| 4,010,835 | 3/1977 | Martin et al. | 400/124 |
| 4,218,149 | 8/1980 | Okada | 400/124 |
| 4,793,252 | 12/1988 | Pichler | 400/124 |
| 4,854,752 | 8/1989 | Rossopoulos | 400/124 |

*Primary Examiner*—Edgar S. Burr

*Assistant Examiner*—Anthony H. Nguyen

*Attorney, Agent, or Firm*—Helfgott & Karas

[57] ABSTRACT

A printing head of the type in which the tips of the needles are guided in two parallel rows by a pair of matrices disposed side by side comprises a support which carries a first matrix. The support is fixed to a printing body. The second matrix is carried by a support movable on the printing body so as to move the second matrix in parallel to the first from a position in which the tips of the needles in the two rows are at the same heights, for high-speed printing to the position in which the tips of the needles in one row are located at the heights of the spaces between the tips of the needles in the other row, for high definition printing. The movable support is connected to the printing body by a parallelogram structure in which two parallel sides are constituted by the support and the printing body while two other sides are formed by resiliently-deformable members. A pre-loaded, resilient biasing member maintains the movable support against a first abutment. An electromagnetic actuator is provided, which, when operated, moves the movable support into contact with a second abutment.

8 Claims, 2 Drawing Sheets

DOT MATRIX PRINTING HEAD FOR HIGH-DEFINITION OR HIGH-SPEED PRINTING

BACKGROUND OF THE INVENTION

The present invention relates to a dot matrix printing head of the type in which the printing needles are guided for movement by the matrix through two adjacent parallel rows of holes therein, each lying in a plane parallel to the printing plane, and arranged to effect high-speed printing o high-definition printing.

Dot matrix printing heads are known, particularly with 24 needles, which are arranged to effect high-speed, low-definition, or "draft", printing and high-definition, or NLQ (near letter quality), printing at a lower speed in alternation, which, although still being distinguished, have a guide matrix for the printing needles provided with a double row of holes disposed side by side so that the tips of the needles which are intended to impact on the printing ribbon to leave a corresponding ink print in the form of a dot on the sheet to be printed, are disposed in two adjacent, parallel rows; the print characters are formed by the printing of a plurality of dots on the sheet in predetermined grids (matrices) by the selective operation of the printing needles. In one known embodiment, the support and guide matrix for the needles is formed from two elements which are relatively slidable parallel to the two rows of needles, one row being guided on a first of the matrix elements and the other on the second; thus, during high-speed, low-definition printing, the needles in the two rows are kept perfectly together in adjacent, coplanar pairs; during high-definition printing (at lower speed), on the other hand, the two elements of the matrix are moved vertically so that the needles in one row are staggered relative to those in the other so that the two rows of needles print characters with partially-superposed dots. This system works quite well but has the disadvantage of requiring complicated mechanisms to effect the movement of the two matrix elements; these mechanisms, in fact, are subject to considerable stress in use and therefore must be adequately dimensioned. This complexity on the one hand reduces the overall reliability of the system and on the other hand renders the drive for the translational movement relatively slow.

SUMMARY OF THE INVENTION

The object of the invention is to provide a dot matrix printing head of the type described above, with needles supported by two separate, relatively movable, matrix elements which has a drive mechanism for the matrix elements which is structurally simple and which is quick and reliable in operation.

This object is achieved by the invention, which relates to a dot matrix printing head including a plurality of needles slidable axially in a printing body, in which respective tips of the needles are guided in two parallel rows by first and second matrix elements disposed side by side and carried, the first by a fixed support attached to the printing body and arranged to move the second matrix element parallel to the first in order to locate it selectively in a first position, in which the tips of the needles in the two rows are at the same heights for effecting high-speed printing, and in a second position in which the tips of the needles in one row are disposed at the heights of the spaces between the tips of the needles in the other row in order to effect high-definition printing; characterised in that the movable support is fixed to the printing body by means of a parallelogram structure in which two parallel sides are constituted by the support and by the body themselves and the other two sides by respective articulation members which are acted upon respectively by resilient means which are pre-loaded so as to hold the movable support normally against a first abutment of the printing body and by an electromagnetic actuator adapted to displace the movable support selectively against the action of the resilient means into contact with a second abutment of the printing body.

BRIEF DESCRIPTION OF THE DRAWINGS

In order to provide a better understanding of the invention, a non-limiting description will now be given of one embodiment, with reference to the appended drawings, in which.

DETAILED DESCRIPTION OF THE INVENTION

Figure 1:
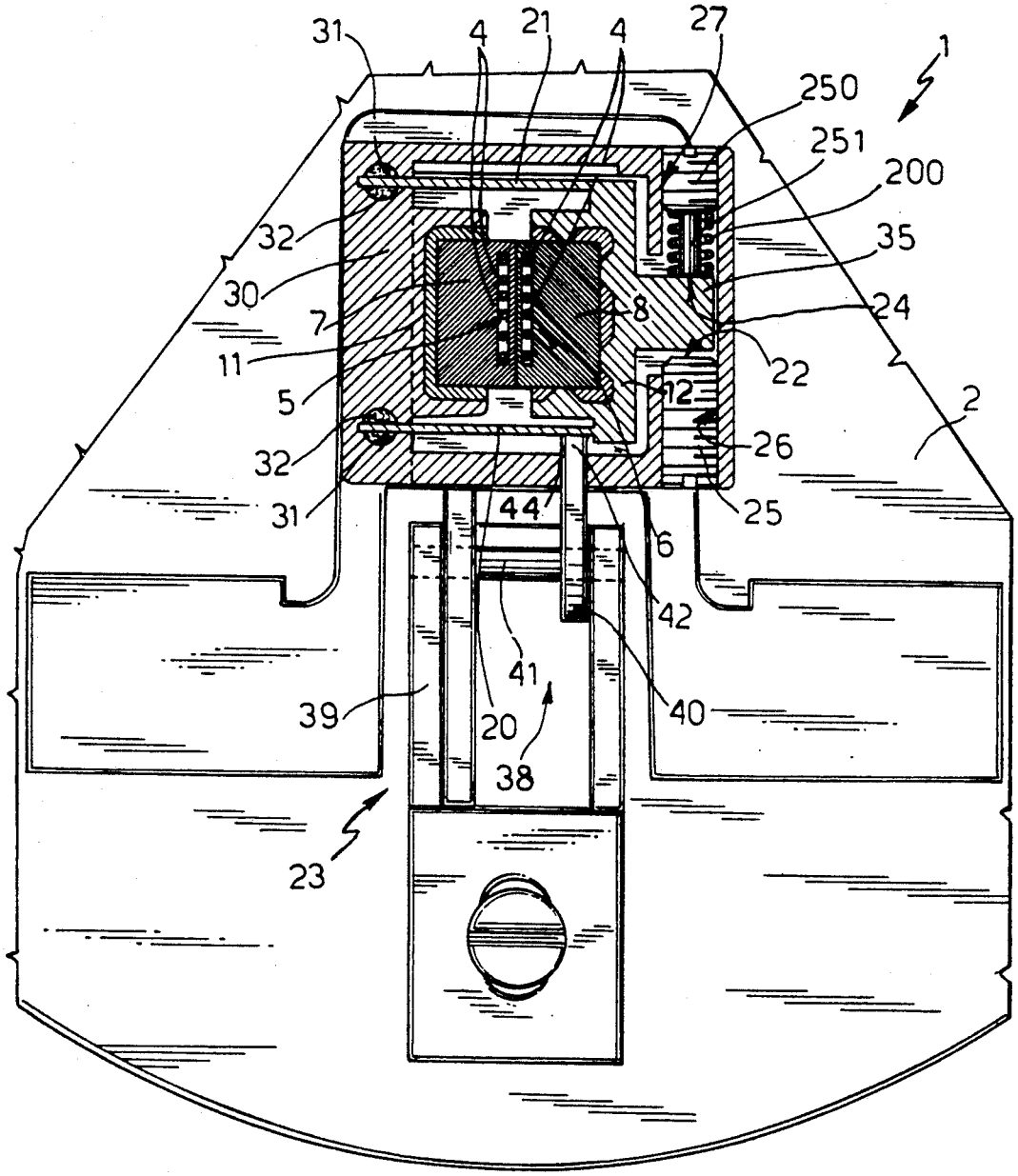
FIG. 1 is a view of a dot matrix printing head according to the invention partly in elevation and partly in section.
Figure 2:
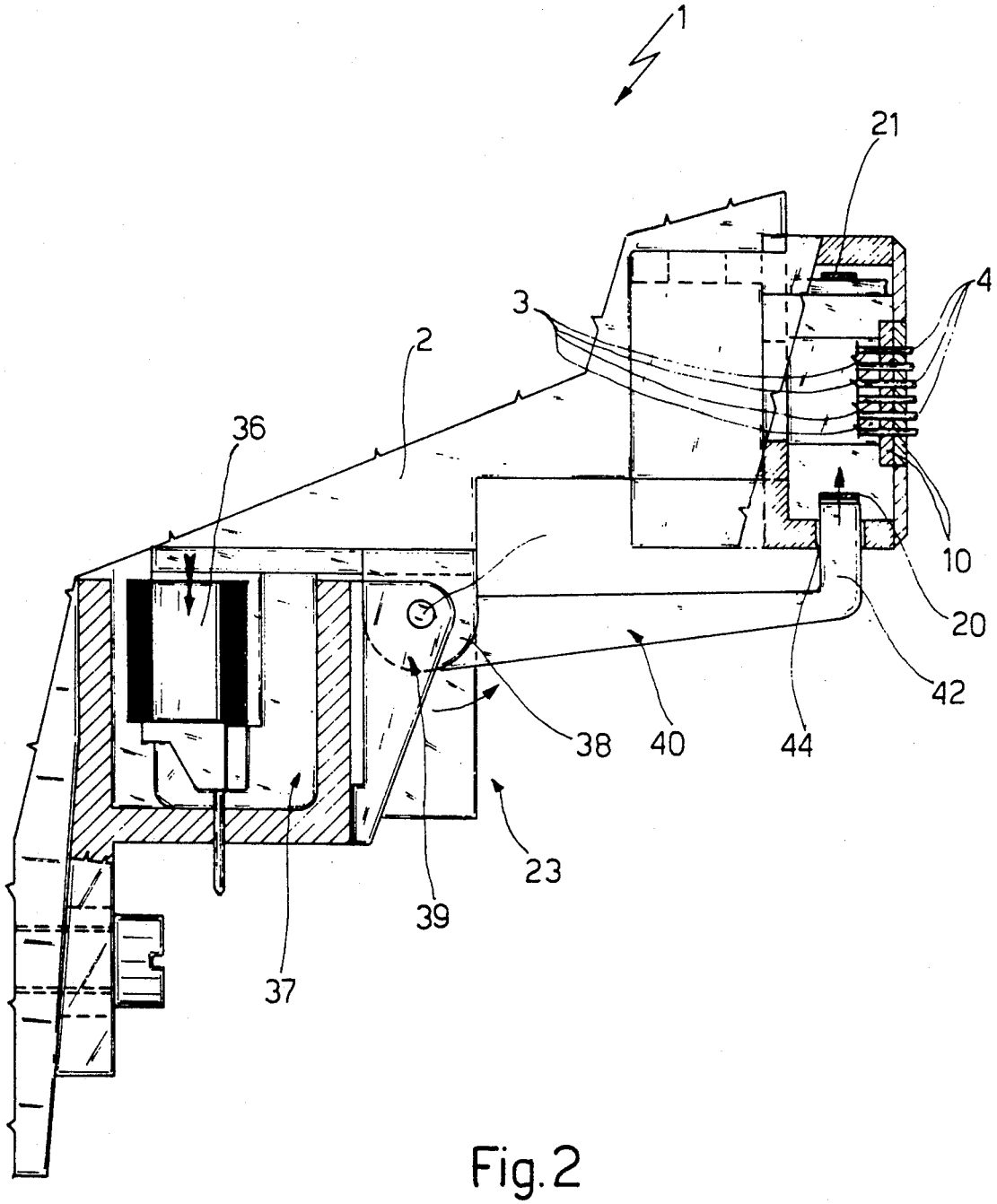
FIG. 2 is a section of a detail of the head of FIG. 1 on an enlarged scale.

With reference to FIGS. 1 and 2, a dot matrix printing head is generally indicated 1 and includes a support body or printing body 2 (of which only the front part is illustrated for simplicity) which can be fitted in known manner to the carriage of a printer and which houses within it, in known manner, a plurality of printing needles 3 driven in known manner, not illustrated for simplicity, by respective electro-magnetic actuators which are controlled by the printer. The printing needles 3 are slidable axially in the body 2 and have respective tips 4 which are guided in two parallel rows 5, 6 by respective different matrix elements 7, 8 disposed side by side and together constituting the advanced guide matrix for the needles 3; when driven by the said actuators, the needles are made to slide through the matrix elements 7, 8 and to impact on the surface of an inked ribbon, not illustrated for simplicity, which leaves a corresponding printed dot on the sheet of paper: by suitable control of the needles 3, one can thus create the desired characters on the paper, each character being formed by a combination of dots disposed in a predetermined configuration.

According to the invention, the matrix elements 7, 8, which are made in known manner from synthetic ruby or from superposed, perforated thin metal sheets 10, are supported, the first by a fixed support 11 attached to the printing body 2 and the second by a movable support 12 carried by the printing body 2 in a position facing and adjacent the support 11 so as to be movable vertically relative thereto: thus the support 12 is able to move the matrix element 8 parallel to the plane of the parallel rows 5, 6 of needles 3, to which the supports 11, 12 are in their turn parallel. More particularly, the support 12 enables the element 8 to be disposed selectively in a first position, illustrated in FIG. 1, in which the tips 4 of the needles 3 in the two rows 5, 6 are disposed at the same heights, that is, in which the tips of the needles in the row 5 are coplanar, in the direction transverse the row itself, with the tips of the corresponding needles 3 (by position in the row) in the row 6, and in a second known position, not illustrated for simplicity, in which the tips 4 of the needles 3 in one row are disposed at the height of the spaces between the tips of the needles 3 in the other row, that is, in which, in effect, the row 6 has been translated downwardly, parallel to itself, by a distance substantially equal to half the spacing between the needles 3 in each row (this spacing being identical in the two rows 5, 6) so as to position the tips 4 of the needles in the row 6 at the heights of the spaces between the tips 4 of the needles in the row 5. As known, in the first position the printing head 1 is able to effect high-speed printing while, in the second position, the head is able to effect high-definition, or NLQ, printing in that, by suitable control of the needles 3, the dots which are printed on the sheet of paper by the needles in the row 6 are interposed or, for example, partially superposed on those produced by the needles in the row 5, thus generating substantially continuous characters.

According to the main characteristic of the invention, the movable support 12 is fixed to the printing body 2 by a kinematic structure of the parallelogram type, in which two parallel sides (in this case the shorter vertical sides) are constituted by the support and by the body itself and the other two sides (in this case the longer horizontal sides) by a pair of articulation members, in this case two resiliently deformable, flexible brackets 20, 21 which are preferably made integrally with the movable support 12 by moulding together therewith from synthetic plastics resin. In addition, an helical spring 200 acts on the movable support and is preloaded so as to keep the movable support 12 normally against a first abutment 22 of the printing body 2 while, at the same time, an electromagnetic actuator 23 acts on the movable support 12 to urge it, against the action of the resilient means 200, into contact with a second abutment 24 of the body 2 disposed parallel to and facing the abutment 22. These abutments are defined, in the preferred embodiment of the invention, by two screws 25 and 250 respectively of the grub screw type which are independent of each other and screwed into respective threaded seats 26, 27 formed in the body 2 in coaxial, facing positions with their axes parallel to the rows 5, 6 of tips 4 of the needles 3.

As illustrated non-limitingly in the appended drawings, the movable support 12 and the fixed support are constituted by respective channel-section members disposed parallel to the rows 5, 6 of aligned needles; the fixed support 11 is attached, for example, by gluing, to an internal side wall 30 of the body 2 and the movable support 12 is disposed facing the fixed support 11, being suspended on the leaf springs 20, 21. These are disposed substantially perpendicular to the wall 30, being fixed at their opposite ends in the wall itself and to the movable support 12 respectively. The fixing of the springs 20, 21 in the wall 30 is achieved by the insertion of the springs themselves in respective through-seats 31 formed in the side wall 30 and filled with an adhesive 32. The movable support 12 also has a shoulder 35 which projects laterally therefrom on the opposite side from the fixed support 11, the shoulder fitting into the space between the screws 25, 250 in the printing body 2 so as to be located between the opposing abutments 22, 24 with the possibility of coming into abutment with either of them.

The electromagnetic actuator 23 includes an electromagnet 36 disposed in a seat 37 in the body 2, which seat is formed in a position underlying that of the matrix elements 7, 8 and spaced therefrom so as not to increase the bulk of the tip of the printing body 1, and a double-cranked transmission lever 38; this lever is in fact constituted by two L-shaped members 39, 40 pivoted at the middle (that is, at the junction of its respective arms) on a common pin 41 mounted in the body 2 close to the seat 37 for the electromagnet 36. The member 40 terminates in an end 42 bent at right angles to the rest of the arm, the end passing through an aperture 44 formed in the body 2 and acting directly on the lower member 20, close to the movable support 12. The spring 200 on the other hand acts directly on the shoulder 35 on the opposite side from the actuator 23 and in this case is housed partly in the seat 26 for its screw 250 and surrounds a shank or stem 25 carried by the latter and projecting towards the screw 25, the end surface of the stem thus defining the abutment 24.

In use, the electrical connection of the printing head 1 is effected so that the electromagnet 36 is normally energised: in these conditions, the member 39 is attracted by the electromagnet 36 in the direction of the arrow (FIG. 2) and comes to rest against it and thus causes the lever 38 to pivot in the sense of the arrow such that its member 40 is forced upwards and its end 42 keeps the support 12 in contact with the abutment 24, against the action of the spring 200 and with the resilient deformation of the members 20, 21. In these conditions, the printing head 1 is enabled to print at high speed since the tips 4 of all the needles in the row 5 are in coplanar alignment, in a direction perpendicular to the row itself, with the tips 4 of the corresponding needles in the row 6; even though the printing head 1 operates at high speed and the movement of the needles 3 induces relatively high stresses in the matrix elements 7, 8, the printing quality is extremely good and the drive mechanism for the element 8 is stressed to an acceptable extent in that there is n possibility of the element 8 vibrating in a uncontrolled manner since it is fixed to the support 12 which is held in contact with the abutment 24 by the magnet 36, the stresses thus being discharged on the abutment 24 and consequently being absorbed by the body 2.

When it is necessary to change over to high-definition printing, it suffices to de-energise the magnet 36: consequently the spring 200, which was originally preloaded and which was also held under load by the lever 38, is released and thrusts the support 12 into contact with the abutment 2 and the lever 38 into its rest position, illustrated in FIG. 2, in which the member 39 is moved away from the magnet 36 and comes to bear at the end of its travel against the body 2, on the outside of the seat 37: this movement is allowed by the elements 20, 21 which in fact help it, preferably being shaped so as to keep the shoulder 35 in contact with the abutment 22 when undeformed. Hence the tips of the needles in the row 6 become positioned at the heights of the spaces between the tips of the needles in the row 5 and are kept firmly in these positions by the pre-loading of the spring 200 which is sufficiently strong to ensure that the support 12 is held in contact with the abutment 22 even in the presence of vibrations or other mechanical stresses. When it is necessary to change back to high-speed printing, the magnet 36 is re-energised, returning the matrix elements 7, 8 to their positions of perfect alignment.

The advantages of the invention will be clear from what has been described; the structure of the head is very simple and of limited bulk, particularly in the region of the tip which supports the needle-guiding matrix defined by the elements 7, 8. The drive for the translational movements of the movable element 8 is simple, direct, rapid and reliable. In short, the entire structure for moving the element 8 and its support 12 is simple, cheap and highly reliable in that it is substantially insensitive to stresses which are transmitted by the needles 3 in use. Finally, the fact that the abutments which define the two positions of the element 8 are constituted by screws enables the fine adjustment of their relative positions and also enables the movement of the element 8 to be linked to that of the lever 38 which is controlled by the magnet 36: in fact, in the structure described, there is no mechanical connection between the lever 38, the magnet 36 and the support 12 for the element 8, the lever 38 acting as a rocker arm which comes to bear alternately against them both, while however leaving them fixed to each other. In these conditions, the amplitude of the movement of the support 12, even though this movement itself is controlled by the magnet 36, depends exclusively on the relative positions of the abutments 22, 24 which considerably simplifies the control of the magnet 36.

Finally, it is clear that what has been described may be varied and modified without thereby departing from the scope of the invention. In particular, the spring 200 and the members 20, 21 may be mutually incorporated, the members 20, 21 being replaced by leaf springs.

I claim:

1. A dot matrix printing head comprising a printing body, a plurality of needles slidable axially in the printing body, first and second matrix elements, respective tips of the needles being guided in two parallel rows by the first and second matrix elements (7, 8) which are disposed side by side, said first matrix element being carried by a first fixed support (11) fixed to the printing body and said second matrix element being carried by a second movable support (12) carried by the printing body and arranged to move the second matrix element parallel to the first matrix element to locate it selectively in a first position, in which the tips of the needles in the two rows are at the same heights for effecting high-speed printing, and in a second position, in which the tips of the needles in one row are disposed at the heights of the spaces between the tips of the needles in the other row in order to effect high-definintion printing, a parallelogram structure, a resilient means (200), a first abutment and a second abutment each provided on and fixed to the printing body, the second movable support (12) being connected to the printing body (2) by said parallelogram structure in which two parallel sides are constituted by the second movable support and by the printing body and other two sides are constituted by respective articulation members which are acted upon respectively by the resilient means (200) which is preloaded so as to hold the second movable support normally against the first abutment (22) of the printing body, and an electromagnetic actuator (23) provided separately from said parallelogram structure and being adapted to displace the second movable support selectively against the action of the resilient means into contact with the second abutment (24) of the printing body, said second abutment being opposed to and facing said first abutment.

2. A printing head, according to claim 1, wherein the abutments for the movable support are defined each by a respective one of two screws (25, 250) screwed into respective threaded through-seats (26, 27) in the printing body, the seats being coaxial with and facing each other and arranged parallel to said rows (5, 6) of the needle tips.

3. A printing head according to claim 1, wherein the movable support and the fixed support are constituted by channel-section members (11, 12) disposed parallel to the rows of needle tips, the fixed support being fixed against an inner side wall (30) of the printing body and the movable support facing the fixed support and being suspended from the articulation members (20, 21).

4. A printing head according to claim 3, wherein the articulation members are constituted by respective resiliently-deformable flexible brackets (20, 21) disposed perpendicular to the inner side wall and fixed at opposite ends thereof in the inner side wall and the movable support, respectively.

5. A printing head according to claim 4, wherein the brackets (20, 21) are formed integrally with the movable support and made therewith by moulding from a synthetic plastics material; and wherein the fixing of the brackets to the inner side wall of the printing body is obtained by insertion of the brackets into respective through-seats (31) formed in the inner side wall and filled with adhesive (32).

6. A printing head according to claim 2, wherein the movable support has a shoulder (35) projecting laterally therefrom on a side thereof opposite the first fixed support, the shoulder being inserted between the abutments (22, 24) of the printing body.

7. A printing head according to claim 6, wherein the resilient means consists of a helical spring (200) which acts directly on the shoulder (35) of the movable support and which is mounted so as to surround a shank (251) of a first of the screws (250) and be partially housed in one of the seats (27), the shank defining said second abutment (24).

8. A printing head according to claim 1, wherein the electromagnetic actuator comprises an electromagnet (36) disposed in the printing body underneath the matrix elements, and a double-cranked transmission lever (38) which is pivoted intermediate ends thereof on the printing body close to the electromagnet and has one end (42) bent at right angles and passing through an aperture (44) formed in the printing body, said one end acting directly on a first of the articulation elements (20) close to the movable support.

* * * * *